US005094728A

United States Patent [19]

Entner

[11] Patent Number: 5,094,728

[45] Date of Patent: Mar. 10, 1992

[54] REGULATION AND STABILIZATION OF THE $ALF_3$ CONTENT IN AN ALUMINUM ELECTROLYSIS CELL

[75] Inventor: Peter Entner, Sierre, Switzerland

[73] Assignee: Alusuisse-Lonza Services Ltd., Zurich, Switzerland

[21] Appl. No.: 693,939

[22] Filed: Apr. 29, 1991

[30] Foreign Application Priority Data

May 4, 1990 [CH] Switzerland ..... 1527/90

[51] Int. Cl.[5] ..... C25C 3/06; C25C 3/20

[52] U.S. Cl. ..... 204/67; 204/153.1; 204/245

[58] Field of Search ..... 204/67, 245, 153.1

[56] References Cited

U.S. PATENT DOCUMENTS

| | | | |
|---|---|---|---|
| 3,380,897 | 4/1968 | Dewey | 204/153.1 |
| 3,471,390 | 10/1969 | Kibby et al. | 204/245 X |
| 4,654,129 | 3/1987 | Leroy | 204/67 |
| 4,654,130 | 3/1987 | Tabereaux et al. | 204/67 |
| 4,668,350 | 5/1987 | Desclaux et al. | 204/67 |
| 4,766,552 | 8/1988 | Aalbu et al. | 204/245 X |
| 4,814,050 | 3/1989 | McGraw et al. | 204/67 |

FOREIGN PATENT DOCUMENTS

| | | |
|---|---|---|
| 195142 | 9/1986 | European Pat. Off. . |
| 2620738 | 3/1989 | France . |

OTHER PUBLICATIONS

Soviet Inventions Illustrated, Oct. 6, 1982, Zusammenfassung No. 71690 M28.

*Primary Examiner*—Donald R. Valentine

*Attorney, Agent, or Firm*—Bachman & LaPointe

[57] ABSTRACT

A method is used for regulating and stabilizing an $AlF_3$ content (c), which is at least about 10% by weight, in the bath of an electrolysis cell for the production of aluminum from alumina dissolved in a cryolite melt.

The individual state of an aluminum electrolysis cell, in particular of the cathodic carbon sump thereof, is analyzed for a period ($t_1$) from a series of measured values, comprising a plurality of parameters. By means of a model calculation, the optimum time delay (ZV) between the addition of $AlF_3$ and its effect in the electrolyte is determined. The additions (z) of $AlF_3$ are calculated for a preset defined $AlF_3$ content (c) allowing for the time delay (ZV), and $AlF_3$ is added in portions or continuously.

14 Claims, 2 Drawing Sheets

REGULATION AND STABILIZATION OF THE $ALF_3$ CONTENT IN AN ALUMINUM ELECTROLYSIS CELL

BACKGROUND OF THE INVENTION

The invention relates to a method of regulating and stabilizing an $AlF_3$ content, which is at least about 10% by weight, in the bath of an electrolysis cell for the production of aluminum from alumina dissolved in a cryolite melt.

In an electrolysis cell for the production of aluminum, a bath or an electrolyte is used which consists essentially of cryolite, a sodium aluminium fluorine compound ($3NaF.AlF_3$). In addition to the alumina to be dissolved, especially substances which lower the melting point are also added to this cryolite, for example aluminum trifluoride $AlF_3$, lithium fluoride LiF, calcium difluoride $CaF_2$ and/or magnesium difluoride $MgF_2$. Thus, a bath in an electrolysis cell for the production of aluminum contains, for example, 6 to 8% by weight of $AlF_3$, 4 to 6% by weight of $CaF_2$ and 1 to 2% by weight of LiF, the remainder being cryolite. Depending on the content of the additives, the melting point of the bath is lowered in this way to the range from 940° to 970° C., which is the industrially used temperature range.

However, bath additions have not only positive effects such as, for example, a lowering of the melting point, but frequently also have negative effects. For example, the addition of lithium fluoride does not allow foil qualities for capacitors to be obtained without special treatment of the metal.

Within the scope of the present invention, the only baths of interest are baths with additions of $AlF_3$, which is a Lewis acid, leading to an excess of at least 10% by weight. This excess is expressed as the $NaF/AlF_3$ molar ratio or weight ratio including the cryolite, or as the percentage content of the excess of free $AlF_3$. The second variant is selected for the text which follows, as already indicated by the above numerical examples.

By means of the addition of $AlF_3$ the liquidus line of the ternary cryolite/alumina/aluminum trifluoride system can be lowered according to a square law. An addition of 10% by weight of $AlF_3$ effects a lowering of the temperature by about 25° C. Because of the known square dependence on the concentration, it is an obvious aim to operate with higher concentrations of aluminum fluoride, in particular since further advantages have also been recognized:

Because of the lower temperature, the bath components are less aggressive, thereby the service life of the electrolysis cell can be extended. Moreover, the anode consumption can be kept lower, which has an additional effect on the economics.

Less aluminum dissolves in the electrolyte, which means a higher current yield.

The molten metal contains less sodium, which reduces the service life of the cathode.

It has also been shown, however, that the lowering of the bath temperature by a high $AlF_3$ content has not only advantages, but that resulting disadvantages also have to be accepted:

The solubility of alumina in the electrolyte is reduced.

The electrical conductivity of the bath decreases with increasing $AlF_3$ content and decreasing temperature. The stability of the solidified side bank decreases.

The solubility of aluminum carbide increases steeply with increasing $AlF_3$ content. As a result, above all the three-phase zone (carbon lining, electrolyte, molten metal) is impaired, especially if there is no protection by solidified electrolyte material. Moreover, dissolved aluminum carbide migrates to the anode and lowers the current yield by reaction.

Sodium ions are charge carriers of the electrolysis current, whereas the aluminum ions are reduced at the cathode. Therefore, a high $NaF/AlF_3$ ratio arises in this region, which can lead to the solidification of electrolyte material.

Furthermore, in addition to these known disadvantages, it has been found that, at an $AlF_3$ content at or above 10% by weight, fluctuations of a wavelength of several days, for example 10 to 30 days, can arise in the bath. During this period, the $AlF_3$ content fluctuates slowly within wide limits, for example in the range from 6 to 20% by weight.

In accordance with the abovementioned square law, these fluctuations of the $AlF_3$ content also involve temperature fluctuations, for example in the range from 930° to 990° C. Moreover, an aluminum fluoride content at or above 10% by weight entails fluctuations in the liquid level in the range of 10–30 cm. At lower $AlF_3$ contents below 10% by weight, no such pronounced fluctuations have been found.

SUMMARY OF THE INVENTION

It was the object of the inventor to provide a method of the type described above, by means of which the fluctuations of the $AlF_3$ content and hence the bath temperature can be reduced to a low standard deviation, to about 1 to 2% for the $AlF_3$ content even without additions of lithium fluoride. Neutralizing additions having an effect in the opposite direction such as, for example, soda or sodium fluoride, should have to be used only in exceptional cases or not at all.

According to the invention, the object is achieved when the individual state of an aluminum electrolysis cell, in particular of the cathodic carbon sump thereof, is analyzed for a period $t_1$ from a series of measured values, comprising a plurality of parameters, the optimum time delay between the addition of $AlF_3$ and its effect in the electrolyte is determined by means of a model calculation, the additions of $AlF_3$ for a preset defined $AlF_3$ content are calculated allowing for the time delay and $AlF_3$ is added in portions or continuously.

BRIEF DESCRIPTION OF THE DRAWINGS

In accordance with the accompanying drawings.

DETAILED DESCRIPTION

Figure 1:
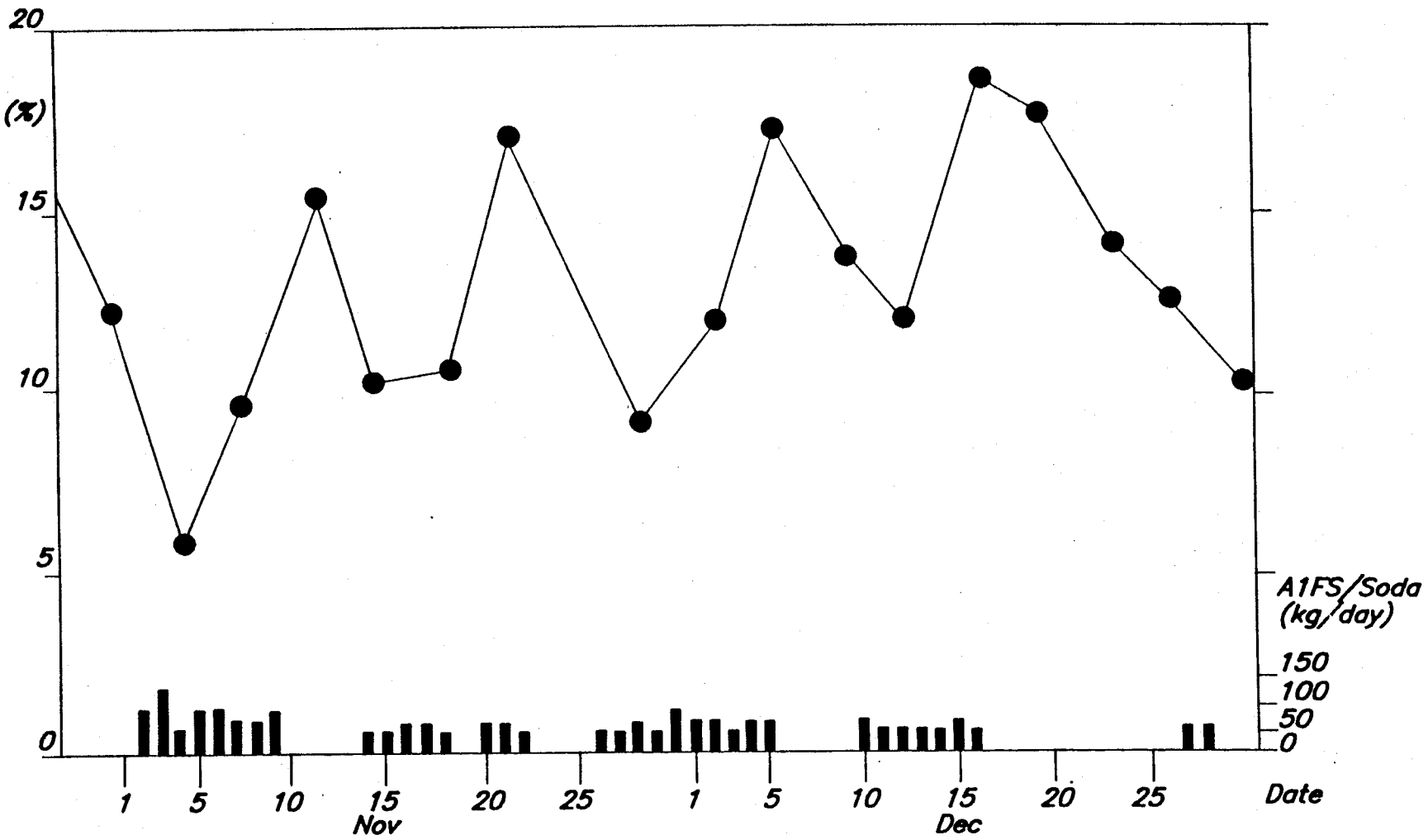
FIG. 1 shows the typical time variation of the $AlF_3$ concentration with the corresponding $AlF_3$ additions.

During the aluminum electrolysis, a loss of $AlF_3$ always occurs, on the one hand due to evaporation, which adversely affects the environment only to a very small degree or not at all in the case of encapsulated aluminum electrolysis cells, and on the other hand due to reaction with $Na_2O$ contained in the added alumina.

Tables for the addition of $AlF_3$ exist which list the units to be added as a function of the bath temperature and of the $AlF_3$ content to be set. These tables can still be refined by allowing for general correction factors such as, for example, the cell age, the number of anode effects, and the trend of the concentration.

It has been found in practice, however, that even the most detailed tables in most cases deviate from the individual reality and the individual requirements of an electrolysis cell. It is, therefore, a fundamental discovery that a regulation and stabilization of the $AlF_3$ content must be preceded by an individual determination and analysis of the cell parameters, which is periodically renewed. This calculation of the cell parameters can be carried out at longer intervals in the case of good cell operation and at shorter intervals in the case of poor cell operation. The inventor has also found that some time, for example about 3 days, elapses between the addition of aluminum trifluoride $AlF_3$ and its effect in the bath, which is allowed for in the model calculation for the $AlF_3$ addition, applied according to the invention.

The time delay of several days between the $AlF_3$ addition and its effect always had the consequence that more aluminum fluoride was added at least daily because of the absence of a reaction, and the target value was then regularly exceeded. Consequently, it was necessary to operate with much too high an $AlF_3$ content, or major quantities of soda $Na_2CO_3$ or sodium fluoride NaF had to be added as a neutralizing antidote, which in turn also reacted with a time delay.

The inventor is able to explain these surprising effects only in such a way that the NaF, all of which is contained in the carbon lining with increasing age of the cell, initially reacts with added $AlF_3$. The sodium fluoride contained in the carbon thus acts as a buffer. The $AlF_3$ concentration in the electrolyte is increased only when saturation has been reached, and falling temperature. The buffer thus returns $AlF_3$ again, and this leads, together with the aluminum fluoride additionally added in the meantime, to an increase in the $AlF_3$ concentration which goes beyond the target.

As indicated, the measurement and analysis of the individual state of an aluminum electrolysis and the determination of the optimum time delay are not only carried out separately for each cell, but if necessary also at different time intervals. In the case of healthy, normally operating cells, this is preferably carried out every 1 to 2 months and, in the case of poor furnace operation, this is repeated outside the program at intervals of 1 to 5 days until the furnace operation improves and the intervals can be extended again. Owing to the individual determination of the current cell state, general tables which allow neither for the cell type nor the state thereof are no longer necessary.

As is known per se, for example from EP-B1 0,195,142, the measurement of the $AlF_3$ content can be replaced by a temperature measurement. This is not only easier but also necessarily detects a temperature dependence of the $AlF_3$ content and can be utilized directly.

The most essential parameters used for the model calculation applied according to the invention are the flux mass M and the daily $AlF_3$ losses v. These parameters are calculated from measurements of the concentration c and the additions z of $AlF_3$ in the electrolyte during a period $t_1$ of preferably 10 to 60 days, in particular 20 to 30 days. The period $t_1$ is, on the one hand, so short that the individual current state of a cell can be detected, but on the other hand, so long that short-term chance alterations without a trend are left out of account.

The calculated flux mass M and the daily $AlF_3$ losses v are entered into the model calculation and this is calculated through with time delays ZV of preferably 1 to 10 full days. The best set of parameters is selected according to statistical criteria known per se and the addition z of $AlF_3$ is calculated for a preset $AlF_3$ content c between 10 and 15% by weight. The presetting of the $AlF_3$ content c depends on the electrolysis temperature regarded as the optimum. This can be obtained, for example, at about 12% by weight of aluminum fluoride.

The best set of parameters, containing the time delay TD, is used over the next n days for the addition a of aluminum fluoride. For this purpose, the following equation is used $$z = M \times (c_s - c_m) = n \times v$$

where M is the flux mass, $c_s$ is the set value of the $AlF_3$ content, $c_m$ is the momentary value of the $AlF_3$ content and v is the daily $AlF_3$ loss.

If the set value $c_s$ corresponds exactly to the momentary value $c_m$, only the losses must be made up.

The period of n days should as a rule not be longer than the period $t_1$, during which the basis for the determination of the parameters were measured. The period is corrected by the time delay ZV.

Using a modified equation, it is possible to predict what the level of the aluminum fluoride content $c_x$ should be on day $t_x$ according to the model calculation. By means of a measurement on the respective day $t_x$, the model can be checked for its suitability and adjusted if necessary.

If, according to the above equation, the calculated value of the $AlF_3$ addition z is negative, the bath is supersaturated with aluminum fluoride and no longer requires any addition. When the method according to the invention is used, only a slight supersaturation with aluminum fluoride or none at all should occur. If this should or must be corrected before the natural levelling-out because of the $AlF_3$ loss, an antidote which likewise acts with a time delay, such as, for example, soda or sodium fluoride, is added. The time delay is also calculated in a cell-specific model device. Moreover, a supersaturation with aluminum fluoride can be corrected by adjusting the voltage.

The soda is preferably added in accordance with the equation $$z_s = \frac{/z/}{1.06}$$

Refined values of fewer days can also be added for determining the optimum time delay ZV for the $AlF_3$ addition z. Since the optimum time delay ZV, determined by the model calculation, for the aluminum fluoride addition in electrolysis cells used in the aluminum industry is as a rule in the range from 2 to 5 days, especially 3 days, time delays ZV of fewer days within this period are calculated through according to a further developed embodiment of the invention and listed for determining the best set of parameters. Even by introducing one digit after the decimal point, the coarse grid for the time delay ZV can be reduced to the fineness required in practice.

The model calculation for determining the optimum time delay ZV and the addition z of aluminum fluoride can be extended by the introduction of additional parameters:

Flux level: Evidently, the electrolyte mass is not only a function of the temperature but especially also of the flux level, in other words the distance of the aluminum surface from the surface of the electrolyte.

Heat balance of the cell: This balance states the quantity of energy which flows out through the bottom, the side walls, the encapsulation and the electrodes. The flow of current not only maintains an electrochemical process but also generates heat due to the electrical resistance of the electrolyte.

Voltage drop: The voltage drop in the electrolyte depends on the number of ions and the mobility of these.

In principle, it is immaterial how the required aluminum fluoride is supplied. Conventionally, the aluminum fluoride is introduced from bags; more modern cells operate with metering devices, and dense fluidized conveying is also used increasingly. The metering equipment or devices are preferably controlled by a process computer and dispense the aluminum fluoride in portions or continuously.

Using the method according to the invention, the fluctuations of the $AlF_3$ concentration in the electrolyte can be reduced to a standard deviation of 1 to 2%, which, in a concentration range from 10 to 15% by weight of aluminum fluoride, leads to simplified process control and to markedly increased production of aluminum. Exceeding of target values can be prevented, and virtually also the addition of an antidote such as soda or sodium fluoride. Electrolyte additives such as, for example, lithium fluoride which manifest themselves by adverse effects in certain uses are unnecessary.

The measured quantities and their dimensional units defined in connection with the present invention are as follows:

c: $AlF_3$ content of the electrolyte (% by weight)
$t_1$: period (days)
z: $AlF_3$ addition (kg/day)
ZV: time delay (days)
M: flux mass (kg)
v: $AlF_3$ losses (kg/day)
$z_s$: soda addition (kg/day)
n: days
$c_s$: set value of $AlF_3$ content (% by weight).

EXAMPLE

FIG. 1 shows the typical time variation of the $AlF_3$ concentration (% by weight) with the corresponding $AlF_3$ additions in kg/day. The considerable variations in the $AlF_3$ excess of between 5 and 15% due to the delayed reaction of the electrolysis cell to the $AlF_3$ addition are evident.

Table I shows the results of the calculation of the model parameters. The $AlF_3$ losses (v in kg/day) were calculated with a given flux mass of 6,000 kg for various time delays (ZV = 1 to 10 days) for a period of 50 days. The set of data having the lowest remainder (ZV = 3 days, dc(0) = 1.14) is selected.

TABLE I $AlF_3$ model: calculation of the model parameters
Period: from final date of 25-12 minus 50 days→starting date 06-11

| ZV Days | v (0) kg/day | P | [dc(0)] % | P |
|---|---|---|---|---|
| 1 | 19.90 | 10 | 1.17 | 2 |
| 2 | 21.53 | 7 | 1.18 | 3 |
| 3 | 24.66 | 1 | 1.14 | 1 |
| 4 | 25.42 | 2 | 1.28 | 4 |
| 5 | 27.94 | 6 | 1.40 | 5 |
| 6 | 28.79 | 8 | 1.54 | 6 |
| 7 | 28.07 | 9 | 1.64 | 10 |
| 8 | 27.30 | 5 | 1.63 | 7 |
| 9 | 26.31 | 4 | 1.63 | 8 |
| 10 | 25.62 | 3 | 1.63 | 9 |

Table II shows the calculation of the optimum addition for stabilizing the $AlF_3$ concentration.

TABLE II

Calculation of the $AlF_3$ additions
Period: from starting date of 31-12 plus 7 days→final date 06-01

| | | | | Operating values | | | Starting values | | | Calculation | | |
|---|---|---|---|---|---|---|---|---|---|---|---|---|
| Date | f | x | $T_f$ | z | $z_s$ | c | z | $z_s$ | c | z | $z_s$ | c |
| 06-01 | | | | | | | | | | 20 | 0 | 12.1 |
| 05-01 | | | | | | | | | | 20 | 0 | 11.5 |
| 04-01 | | | | | | | | | | 20 | 0 | 10.9 |
| 03-01 | | | | | | | | | | 60 | 0 | 10.3 |
| 02-01 | | | | | | | | | | 60 | 0 | 9.7 |
| 01-01 | | | | | | | | | | 60 | 0 | 10.1 |
| 31-12 | | | | | | | | | | 60 | 0 | 10.5 |
| 30-12 | 16 | 23 | 967 | | | 10.3 | | | 10.3 | | | |
| 29-12 | 16 | 23 | 960 | 0 | 0 | | 0 | 0 | | | | |
| 28-12 | 18 | 23 | 967 | 40 | 0 | | 40 | 0 | | | | |
| 27-12 | 17 | 23 | 961 | 40 | 0 | | | | | | | |
| 26-12 | 17 | 23 | 957 | 0 | 0 | 12.7 | | | | | | |
| 25-12 | 13 | 23 | 935 | 0 | 0 | | | | | | | |
| 24-12 | 14 | 23 | 941 | 0 | 0 | | | | | | | |
| 23-12 | 15 | 22 | 940 | 0 | 0 | 14.2 | | | | | | |
| 22-12 | 14 | 23 | 943 | 0 | 0 | | | | | | | |

Key:
f: flux level (cm)
x: metal level (cm)
$T_f$ flux temperature (°C.)
z, $z_s$: $AlF_3$ addition, soda addition (kg/day)
c: $AlF_3$ concentration (% by weight)

Figure 2:
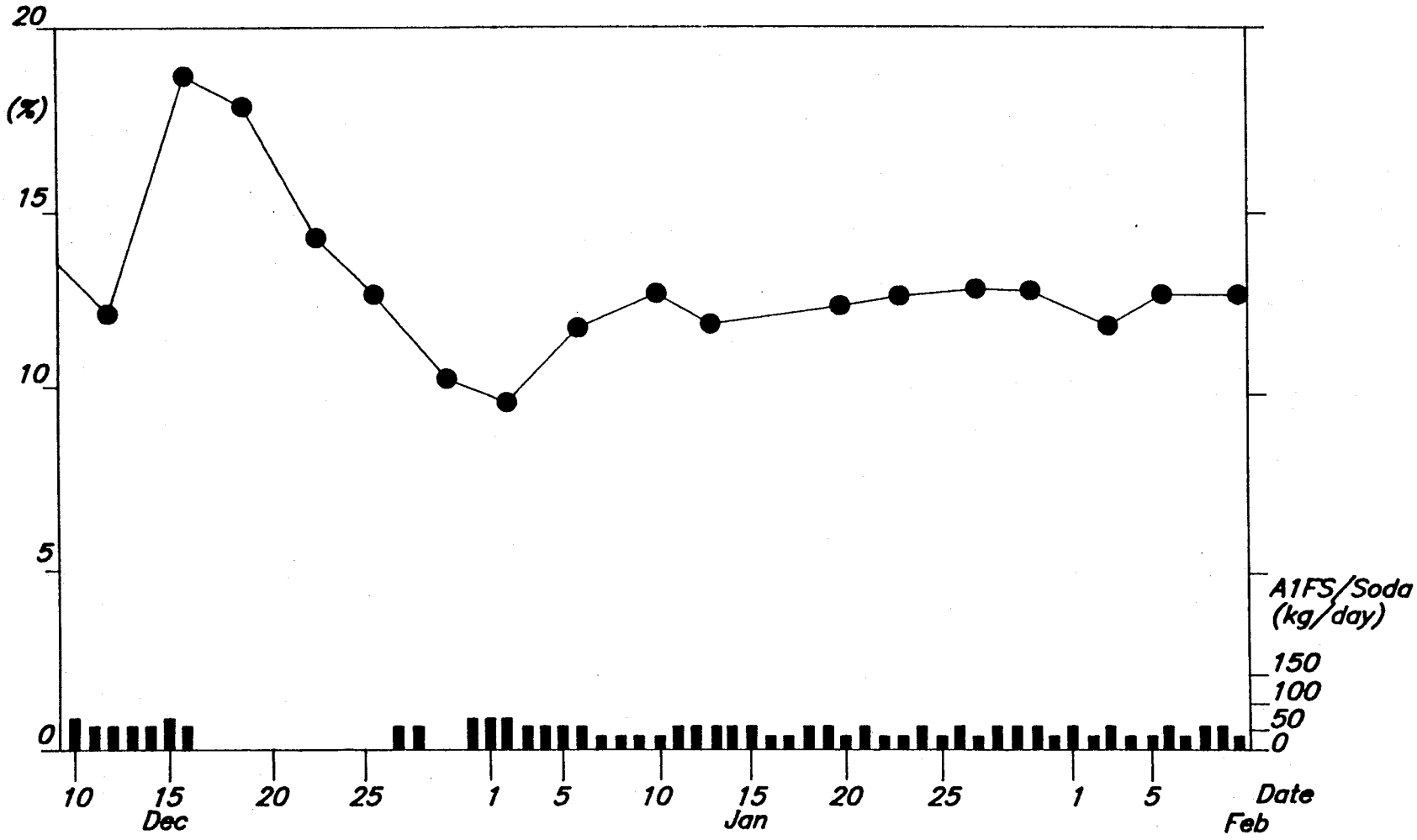
FIG. 2 shows the variation of the $AlF_3$ concentration with time alter employing the model calculations.

FIG. 2 shows the variation of $AlF_3$ concentration (% by weight) with time in accordance with FIG. 1 after employing the model calculations (from January onwards). The substantially improved time stability of the values is evident.

I claim:

1. Method of regulating and stabilizing an $AlF_3$ content (c), which is at least about 10% by weight, in the bath of an electrolysis cell for the production of aluminum from alumina dissolved in a cryolite melt, which comprises: analyzing the individual state of an aluminum electrolysis cell for a period ($t_1$) from a series of measured values, comprising a plurality of parameters; determining the optimum time delay (ZV) between the addition of $AlF_3$ and its effect in the electrolyte by means of a model calculation; calculating the additions (z) of $AlF_3$ for a preset defined $AlF_3$ content (c) allowing for the time delay (ZV); and adding $AlF_3$.

2. Method according to claim 1 wherein including the step of analyzing the cathodic carbon sump of an aluminum electrolysis cell.

3. Method according to claim 1 wherein the analysis of the individual state of an aluminum electrolysis cell and the determination of the optimum time delay (ZV)

are repeated every 1 to 2 months for a cell operating normally.

4. Method according to claim 1 wherein the analysis of the individual state of an aluminum electrolysis cell and the determination of the optimum time delay (ZV) are repeated at intervals of 1 to 5 days in the case of poor furnace operation.

5. Method according to claim 1 wherein the measurement of the $AlF_3$ content is replaced by a temperature measurement.

6. Method according to claim 1 wherein the flux mass (M) and daily $AlF_3$ losses (1) are calculated from measurements of the concentration (c) and the additions (z) of $AlF_3$ in the electrolyte during a period ($t_1$) from 10 to 60 days, and time delays (ZV) are added into the model calculation, wherein the best set of parameters is selected according to statistical criteria and the addition (a) of $AlF_3$ is calculated for a preset $AlF_3$ content between 10 and 15% by weight.

7. Method according to claim 6 wherein the period ($t_1$) is 20 to 30 days and the time delay (ZV) is 1 to 10 full days.

8. Method according to claim 6 wherein at least one parameter of (1) the flux level in the aluminum electrolysis cell, (2) the heat balance thereof, and (3) the voltage drop are included as a refinement in the model calculation for determining the time delay (ZV) and the addition (z) of $AlF_3$.

9. Method according to claim 1 wherein the addition (z) of $AlF_3$ is calculated for the next n days, using the best set of parameters, containing the time delay (ZV), in accordance with the equation $$z = M \times (c_s - c_m) - n \times v$$

where M is the flux mass, $c_s$ is the set value of the $AlF_3$ content, $c_m$ is the momentary value of the $AlF_3$ content and v is the daily $AlF_3$ loss.

10. Method according to claim 9 wherein in the case of a negative $AlF_3$ addition value (z), a neutralization with soda or sodium fluoride is carried out or the voltage is adjusted.

11. Method according to claim 10 wherein soda is added in accordance with the equation $$z_s = \frac{/z/}{1.06}$$

12. Method according to claim 1 wherein refined values of fewer days are added into the model calculation for determining the optimum time delay (ZV) for the $AlF_3$ addition (z).

13. Method according to claim 2 wherein refined values of 2 to 5 days are added into the model calculation.

14. Method according to claim 1 wherein the $AlF_3$ is added from bags or by means of a metering device controlled by a process computer.

* * * * *